US007104930B2

(12) United States Patent
Lo et al.

(10) Patent No.: US 7,104,930 B2
(45) Date of Patent: Sep. 12, 2006

(54) STRUCTURE OF A TREADMILL

(75) Inventors: Kun-Chuan Lo, Taichung (TW); Hung-Mao Liao, Taichung (TW); Chin-Chia Liu, Changhua Hsien (TW)

(73) Assignee: Johnson Health Tech, Taichung (TW)

( * ) Notice: Subject to any disclaimer, the term of this patent is extended or adjusted under 35 U.S.C. 154(b) by 463 days.

(21) Appl. No.: 10/643,887

(22) Filed: Aug. 20, 2003

(65) Prior Publication Data

US 2005/0043146 A1 Feb. 24, 2005

(51) Int. Cl.
*A63B 22/02* (2006.01)

(52) U.S. Cl. ..... 482/54; 482/51

(58) Field of Classification Search ..... 482/51–54, 482/142

See application file for complete search history.

(56) References Cited

U.S. PATENT DOCUMENTS

| | | | | |
|---|---|---|---|---|
| 5,674,453 | A | 10/1997 | Watterson et al. | |
| 5,782,723 | A | 7/1998 | Kuo | |
| 6,682,460 | B1 * | 1/2004 | Lo et al. | 482/54 |
| 6,695,751 | B1 * | 2/2004 | Hsu | 482/54 |
| 6,811,518 | B1 * | 11/2004 | Lin | 482/54 |
| 2002/0142892 | A1 * | 10/2002 | Chen et al. | 482/54 |
| 2004/0063548 | A1 * | 4/2004 | Chang | 482/54 |
| 2004/0087417 | A1 * | 5/2004 | Lo | 482/54 |

FOREIGN PATENT DOCUMENTS

| | | |
|---|---|---|
| TW | 344261 | 11/1998 |
| TW | 493448 | 7/2002 |

* cited by examiner

*Primary Examiner*—Jerome Donnelly
*Assistant Examiner*—Tam Nguyen

(57) ABSTRACT

The present invention relates to an improved structure of a treadmill, more particularly, to a frame structure of an electrical, collapsible treadmill. The frame structure includes a front frame assembly, a rear frame assembly and elevation mechanism disposed under the front frame assembly. The elevation mechanism includes a front leg assembly, a rear leg assembly and an elevation device, of which the front leg assembly and rear leg assembly are pivotally and slidably connected to each other, such that the elevation mechanism is able to support the front and rear frame assembly by means of scissors type supporting structures without the need of a base. When in use, the treadmill can be kept stable without the need of any extra fastening means; whereas when being stored, the treadmill can be folded by only flipping over the rear frame assembly upward. This design makes the convenience in storage and reduces the costs in assembling and manufacturing.

11 Claims, 7 Drawing Sheets

STRUCTURE OF A TREADMILL

CROSS-REFERENCE TO RELATED APPLICATION

Not Applicable

1. Field of the Invention

The present invention relates to an improved structure of a treadmill, more particularly, to a frame structure of an electric, collapsible treadmill.

2. Background of Invention

In order to save storage space, the designers skilled in the field of the collapsible mechanism of an electric treadmill endeavor to develop a new model to overcome any possible restrictions incurred in a treadmill, especially when it is collapsed. For example, U.S. Pat. No. 5,782,723 has disclosed an electric, collapsible treadmill. However, when the treadmill is in use, the collapsible mechanism needs supporting bases to fasten each positioning basis to its corresponding positioning block, in order to stablize the main frame and prevent the treadmill from shaking. Under the circumstances, after using the treadmill, the user must release the aforesaid supporting bases, positioning bases and their corresponding positioning blocks before collapsing the treadmill. It assigns complicated steps when the user proceeds with the collapsing procedures, and reduces the competing capability in the market. Furthermore, such a design of collapsible mechanism provides no possibility to additionally install automatic lifting mechanism, which restricts the functionality of this exercising product.

ROC (Taiwan) Patent Publication No. 344261 modifies the supporting bases as in the aforementioned technology to engaging mechanism in order to similarly keep the stability of the treadmill; however, the modified design still cannot eliminate the complicated procedures of engagement when being in use and the procedures of release after use. Likewise, this modified design is still devoid of the lifting mechanism which can be installed on the treadmill, and therefore the convenience in use is not improved and few positive opinions from customers can be reported.

In ROC (Taiwan) Patent Publication No. 493448, in order to fulfill the eager desire of the functionality, the inventor additionally installs lifting mechanism on his collapsible electric treadmill; however, when being in use, it is still required to utilize a set of fasteners to fasten the treadmill frame and the base of the lifting mechanism, in order to keep the treadmill stable especially when being fully loaded, and meanwhile let the lifting mechanism move up and down together with the treadmill frame. Similarly, the user still needs to release the fastener before collapsing the treadmill. It appears that the disadvantages resulting from the aforementioned designs are not significantly improved in this case. In another aspect, the lifting design in the present case does not result in the synchronous lifting of the handle and dashboard assembly. It follows that when the treadmill frame is being lifted, the relative position of the user to the handle and dashboard assembly will vary all the way during the lifting proceedings. Such an aspect does not fulfill the ergonomic requirement.

Given the above, to offer low production and assembling cost, as well as high product reliability for an electric collapsible treadmill is tremendously important in the marketplace in resolving the aforementioned restrictions. Therefore, the present invention provides a novel and non-obvious liftable, electric, collapsible treadmill which is stated as follows.

SUMMARY OF THE INVENTION

The primary objective of the present invention is to provide a treadmill which has an improved frame structure. This structure is provided with lifting mechanism of which a front leg assembly and rear leg are pivotally and slidably connected to each other, such that the lifting mechanism is able to support the front and rear frame assembles by means of scissors type supporting structure. There is no need to employ additional fastening or engaging mechanism for sustaining the stability of the treadmill. When the user wishes to collapse the treadmill for storage, the treadmill can be folded by only flipping over the rear frame assembly upward without additionally disposing fastening or engaging mechanism to achieve a folded status. Such a design not only makes it more convenient to store the treadmill, but also makes it possible to significantly reduce the assembling cost.

The secondary objective of the present invention is to provide a treadmill which has an improved frame structure. This structure is configured to integrate the front frame and rear frame to a coherent synchronous body. When the lifting mechanism elevate or descends, the integral front and rear frames will synchronously elevates or descend together with the lifting mechanism. That is, there is no relative displacement between the frame and lifting mechanism, which causes that no matter where the handle provided for being gripped by the user and the dashboard assembly providing necessary exercising information for the user are disposed, they will elevate and descend together with the frame of the treadmill without any relative displacement with respect to the frame structure, thereby perfectly fulfilling the ergonomic requirement.

DESCRIPTION OF THE PREFERRED EMBODIMENT

Figure 1:
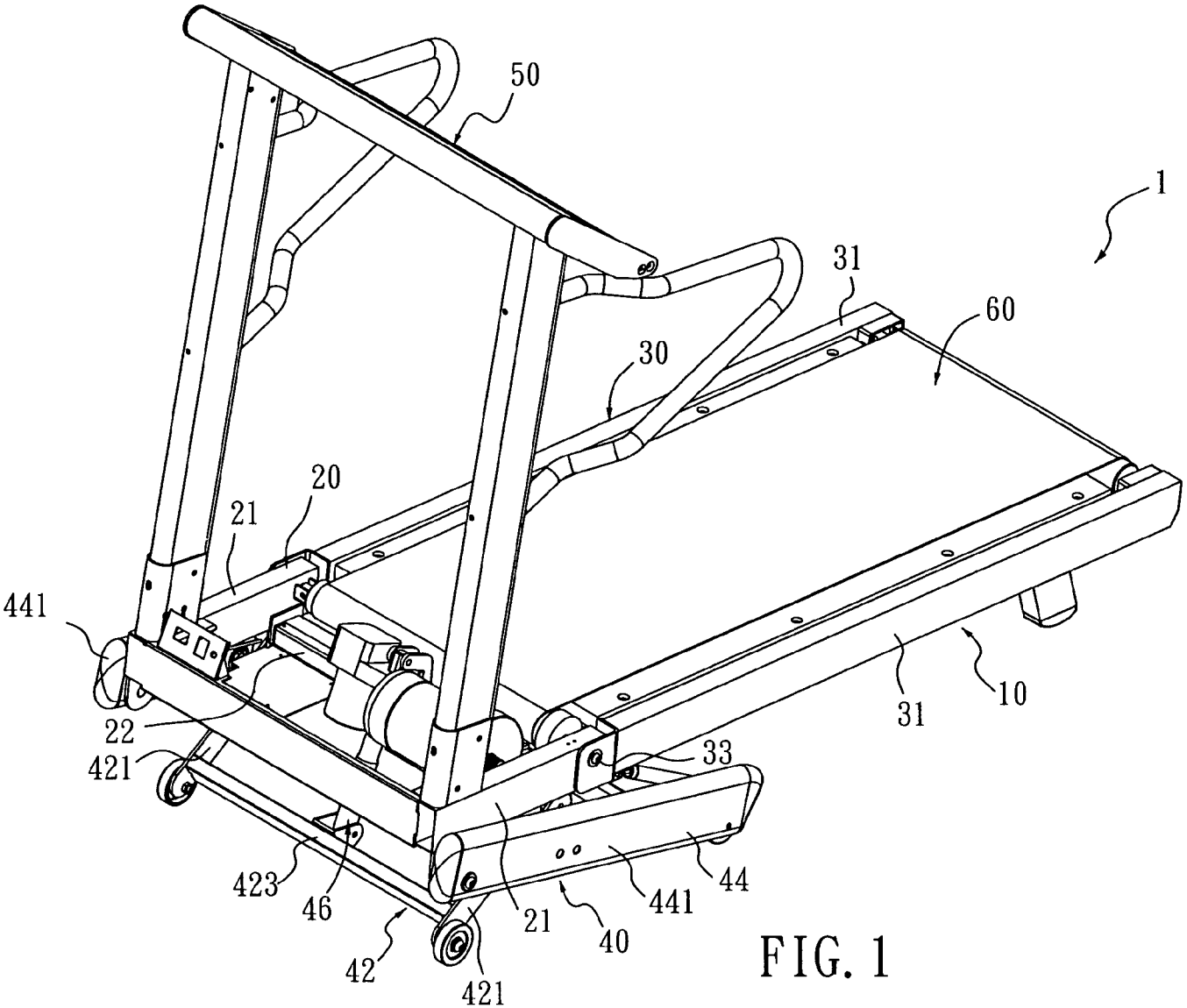
FIG. 1 is a perspective view showing the preferred embodiment of the present invention.

FIG. 1 illustrates a preferred embodiment implementing a collapsible treadmill 1. The collapsible treadmill 1 comprises a frame structure 10, which preferably includes a front frame assembly 20, a rear frame assembly 30 and lifting mechanism 40 and a handle/dashboard assembly 50.

The front frame assembly 20 includes a first end portion and a second end portion opposing to the first end portion. The rear frame assembly 30 also includes a first end portion and a second end portion opposing to the first end portion, of which the first end portion pivots on the second end potion of the front frame assembly 20. More specifically speaking, the relation between the end portions and the rear frame assembly 30 has two rear frames 31 disposed opposing to each other; whereas the front frame assembly 20 has two front frames 21 opposing to each other as well as a front transverse frame 22 connecting between the opposing front frames 21. The front end of each of the rear frames 31 pivots onto the rear end of each of the front frames 21. An endless belt device 60 is disposed between the opposing rear frames 31 for the user to step thereon for exercising purposes. The disposition of the endless belt device relates to a well-known technology which is irrelevant to the features of the present invention, and therefore is not illustrated in details in this case.

The lifting mechanism 40 is generally disposed under the front frame assembly 20, and comprises a front leg assembly 42, a rear leg assembly 44 and a lifting device 46. The front leg assembly 42 includes a first end portion and a second end portion, whereas the rear leg assembly 44 also includes a first end portion and a second end portion. The first end portion of the front leg assembly 42 pivots onto the second end portion of the front frame assembly 20, whereas the first end portion of the rear leg assembly 44 pivots onto the first end portion of the front frame assembly 20. And the front leg assembly 42 and the rear leg assembly 44 pivot onto each other in a sliding manner.

Figure 2:
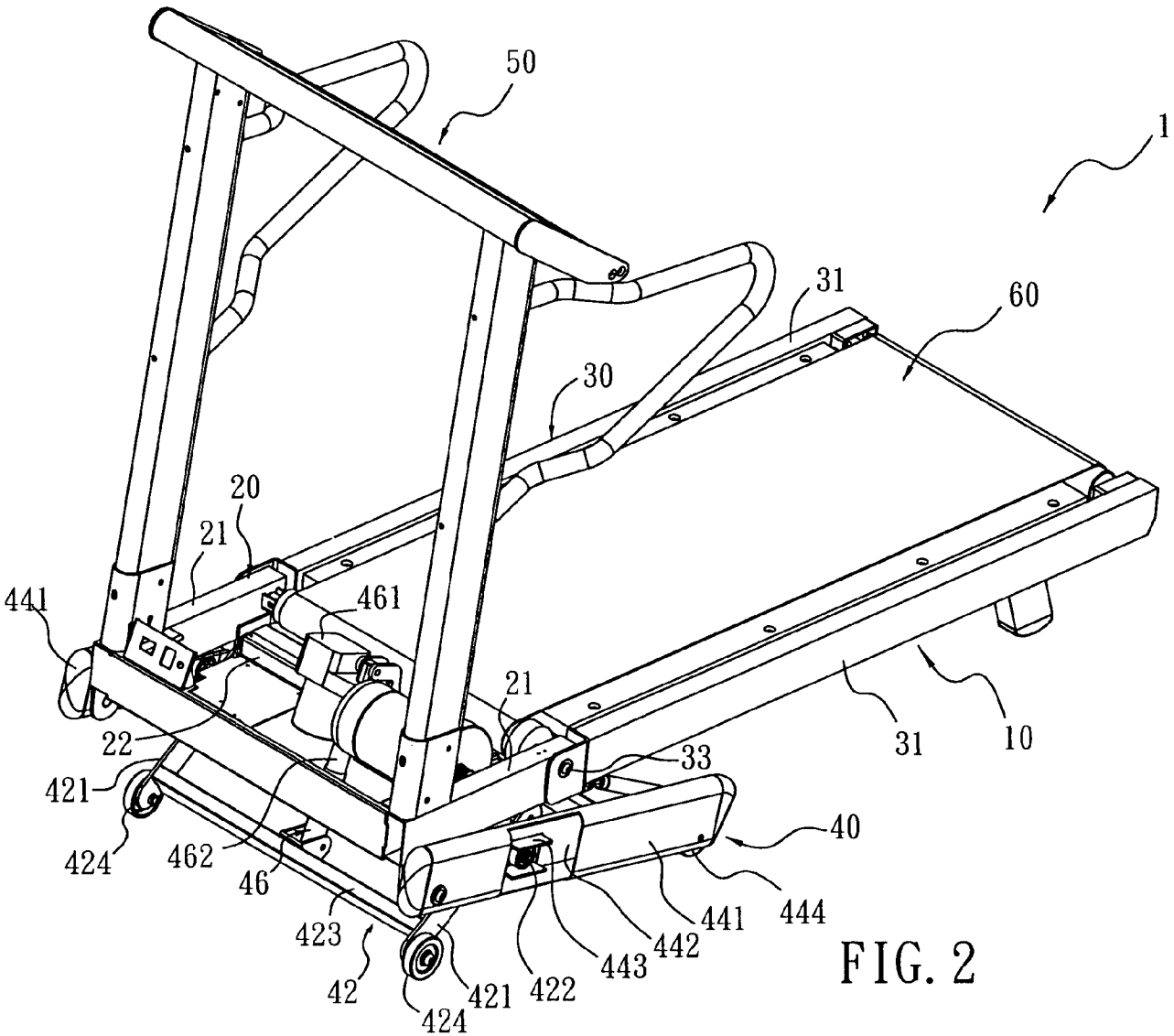
FIG. 2 is similar to FIG. 1 with the illustration of the pivoting relation between the front and rear leg supports.
Figure 3:
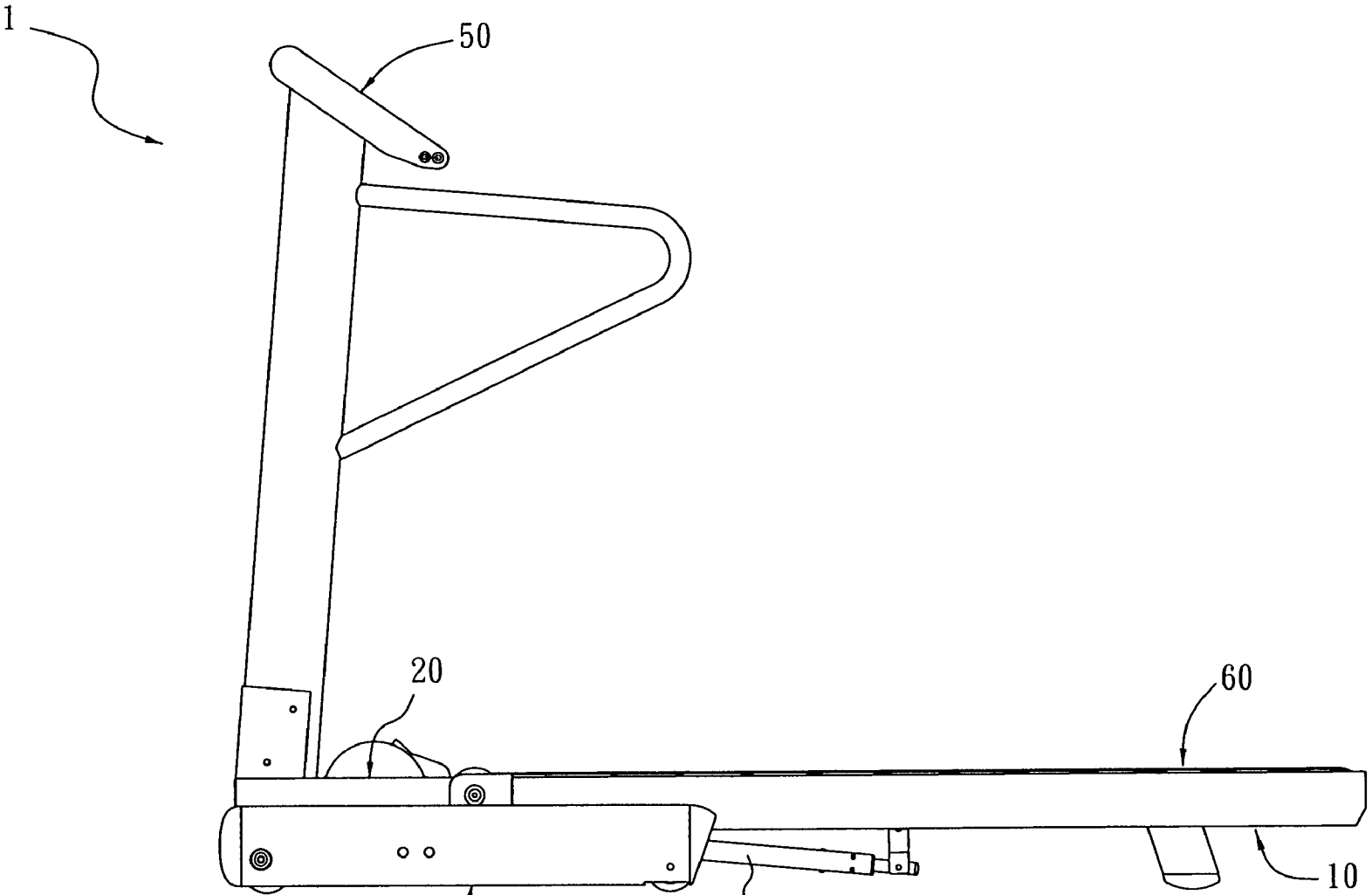
FIG. 3 is a side schematic view showing the status that the frame is in its horizontal position.
Figure 4:
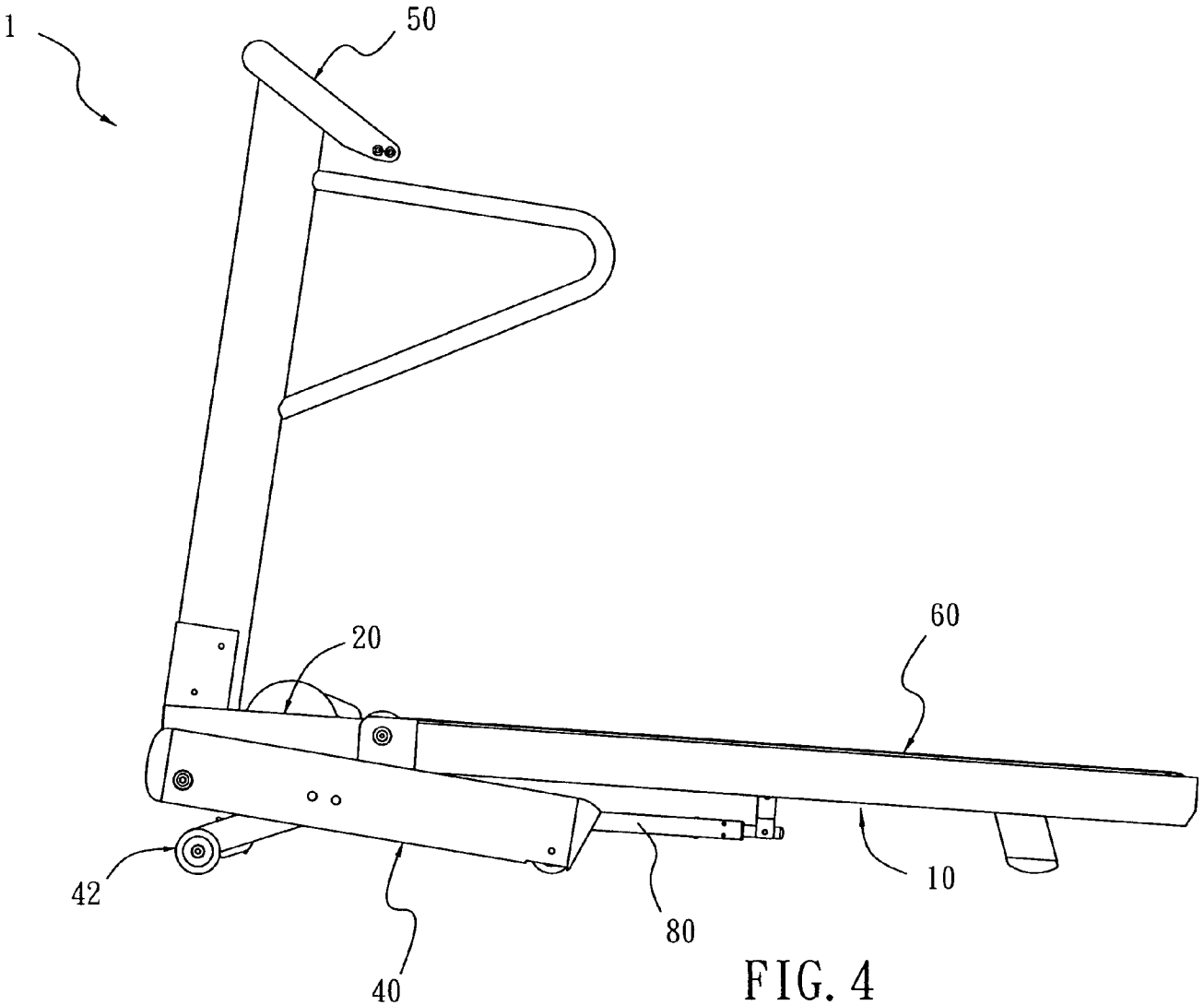
FIG. 4 is a side schematic view showing the status that the frame elevates.
Figure 5:
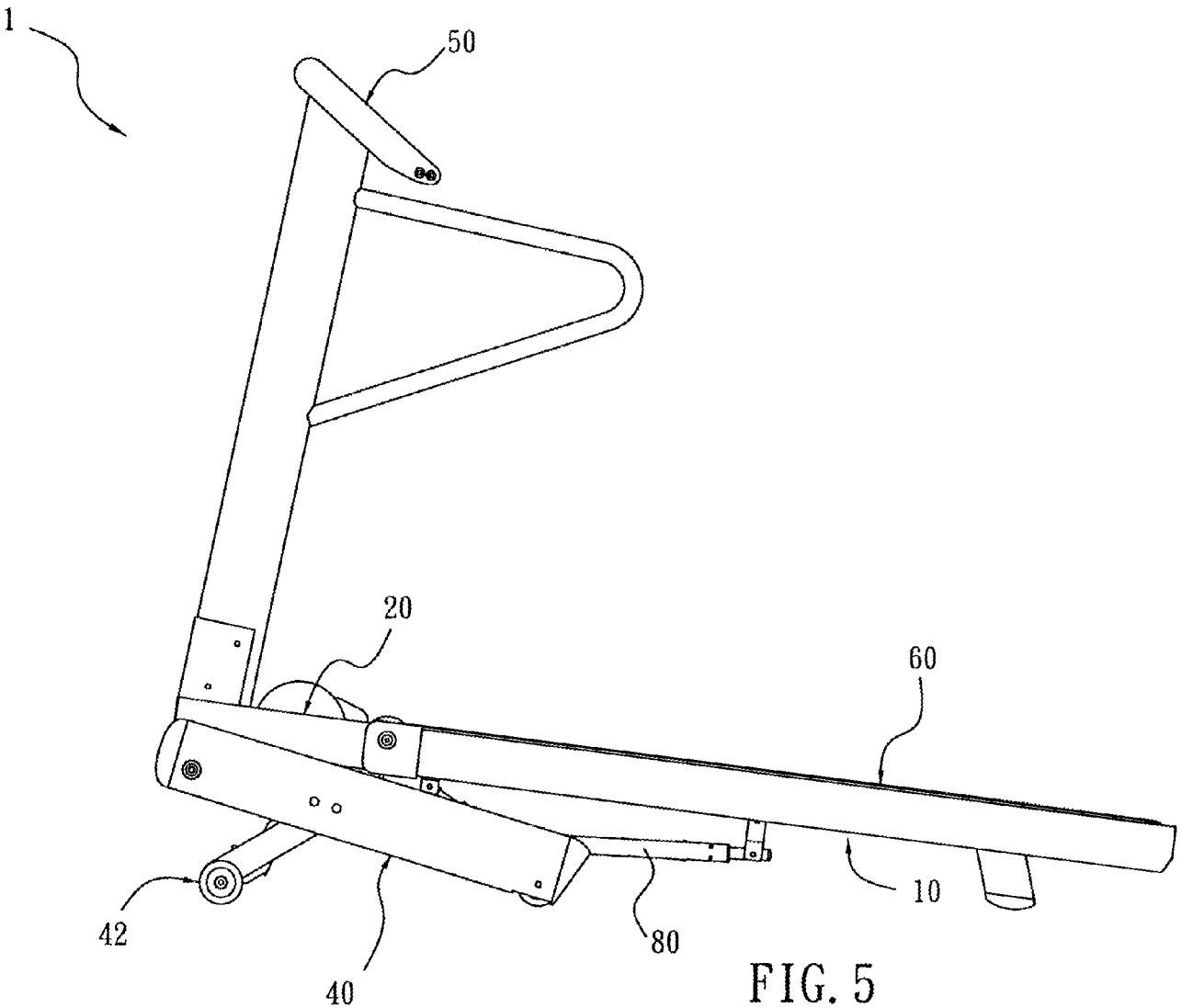
FIG. 5 is a side schematic view showing the status that the frame completely elevates.

The lifting device 46 pivots on the front frame assembly 20 at one end thereof, and pivots on one of the front leg assembly 42 and the rear leg assembly 44 at the other end thereof. As for the relation among the aforesaid end portions, more specifically, the front leg assembly 42 of the lifting mechanism 40 comprises two opposing front legs 421, whereas the rear leg assembly 44 comprises two opposing rear legs 441. Each of the front legs 421 pivots at its rear end on a rear end of each of the front frames 21, whereas each of the rear legs 441 pivots at its front end on a front end of each of the front frames 21. As for the slidable pivoting design between each front leg 421 and each rear leg 441, as shown in the cross sectional view in FIG. 2, a roller 422 is disposed at an: outer side of each of the front legs 421 with a sliding space being defined in the interior of each of the rear legs 441. Such a sliding space 442 can also be confined to a space, as shown in FIG. 2, which is defined between two guiding flanges 443, according to the size of the roller 422 and the actual sliding path as needed for operation. In such a case, the roller 422 of each of the front legs 421 is adapted to roll in the sliding space 442 of each of the rear legs 441, in order to enable each of the front legs 421 to be able to slidably pivot on each of the rear legs 44l.

The pivoting design among each of the front legs 421, rear legs 441 and the front frames 21 can be altered to have the front end of each of the rear legs 441 slidably pivot onto the front end of each of the front frames 21, with each front leg 421 pivoting on each rear leg 441 (not shown in the figures). Specifically speaking, it also works to furnish a roller on the front end of each rear leg and form a corresponding sliding space at the front end of each front frame in order to receive the roller to be rolled therein, as mentioned in the previous embodiment, can also be implemented to accomplish the substantially the same exercising and collapsible purposes as quoted below.

The lifting device 46 pivots at its one end onto the front frame assembly 20, and pivots at the other end onto the front leg assembly 42. Preferably, the front leg assembly 42 further comprises a front transverse leg 423 connected between the two opposing front legs 421. More specifically, the lifting device 46 pivots at its one end onto the front transverse frame 22, and pivots at the other end onto the front transverse leg 423. More preferably, if an electric treadmill is taken as the present embodiment, the lifting device 46 is adapted to include a power device 461 and a lifting shaft 462, in which the power device 461 is mounted onto the front transverse frame 22. The lifting shaft 462 is fixed to the power device 461 at its one end in order to be electrically operated for being lifted and descended by the power device, and the lifting device 462 is pivoted to the front transverse frame 22.

To smoothly and slidably pivot the front leg assembly 42 on the rear leg assembly 44 when being in use, the lifting mechanism 40 further comprises a front leg sliding device (which is implemented by wheels 424) and a rear leg sliding device (which is implemented by wheels 444 in the present embodiment). The front leg wheels 424 are disposed on the second end portion of the front leg assembly 42, whereas the rear leg wheels 444 are disposed on the second end portion of the rear leg assembly 44. More specifically, each of the front leg wheels is disposed at a front end of each of the front legs 421, whereas each of the rear leg wheels 424 is disposed at a rear end of each of the rear legs 441.

With reference to FIGS. 3–7 for the operation of the present preferred embodiment, when the power device 461 operates the lifting device 46 to have the lifting device 46 be retracted to its shortest status, the overall frame of the treadmill can be sustained in a substantially horizontal status. When the power device 461 begins to operate the lifting shaft 46 to be elongated, the opposing ends of the lifting shaft 462 abut against the front transverse frame 22 and the front transverse leg 423 to depart from each other, thereby continuously operating the rollers 422 provided on the front legs 421 to move along the space 442 defined in the rear legs 441 and further operating the wheels 424, 444 provided on the front and rear legs, respectively, to approach each other. This will also cause the rear ends of the front legs 421 to approach the front ends of the rear legs 441 due to such a scissors arrangement, thereby causing the front frame assembly 20 and rear frame assembly 30 to elevate integrally. Because the handle/dashboard assembly 50 is installed on the front frame assembly 20, the aforesaid elevation also lifts the handle/dashboard assembly 50. The user does not have a non-ergonomic feel when using the treadmill, especially when it elevates or descends occasionally.

Figure 6:
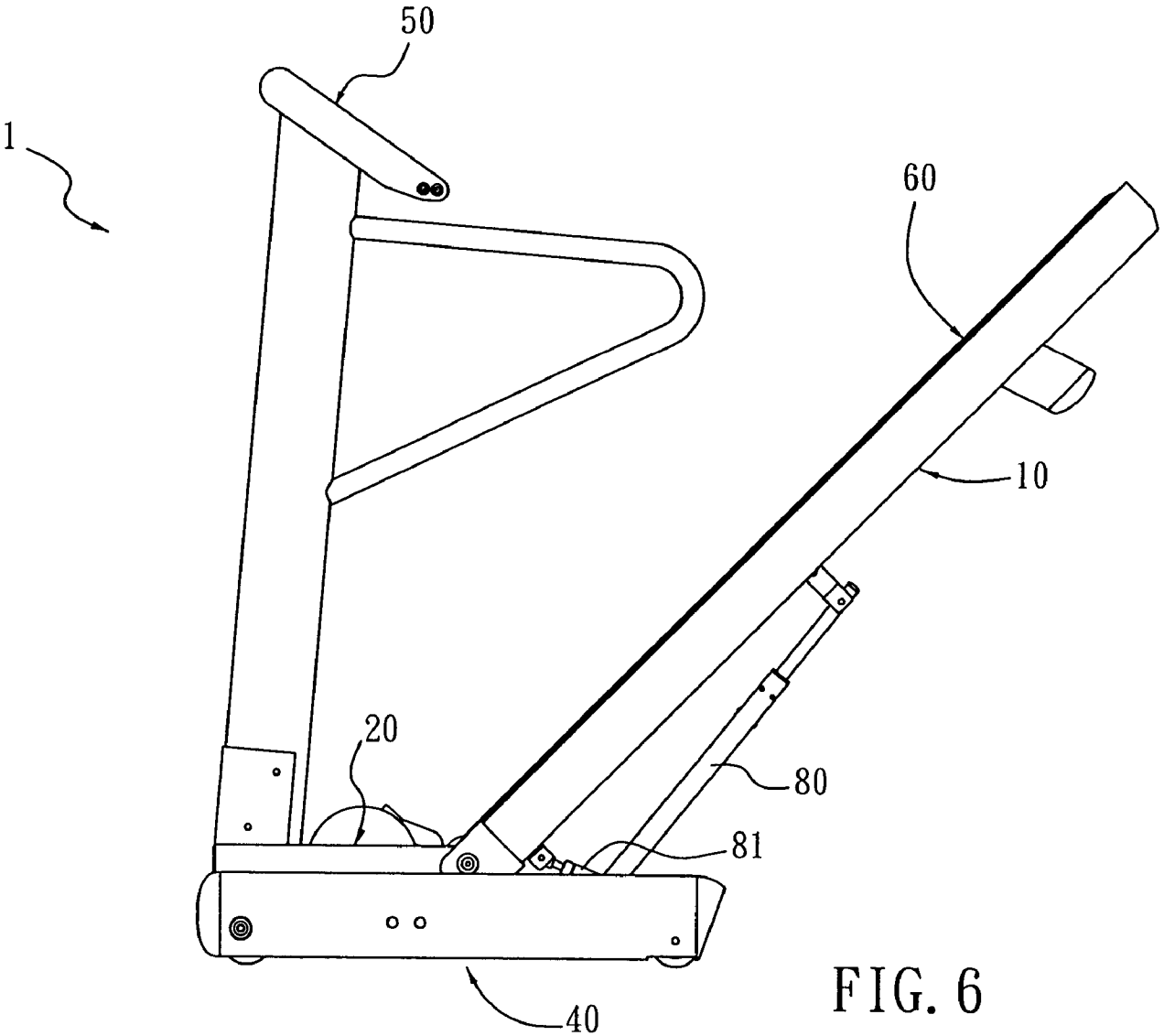
FIG. 6 is a side schematic view showing the status that the frame is collapsed.
Figure 7:
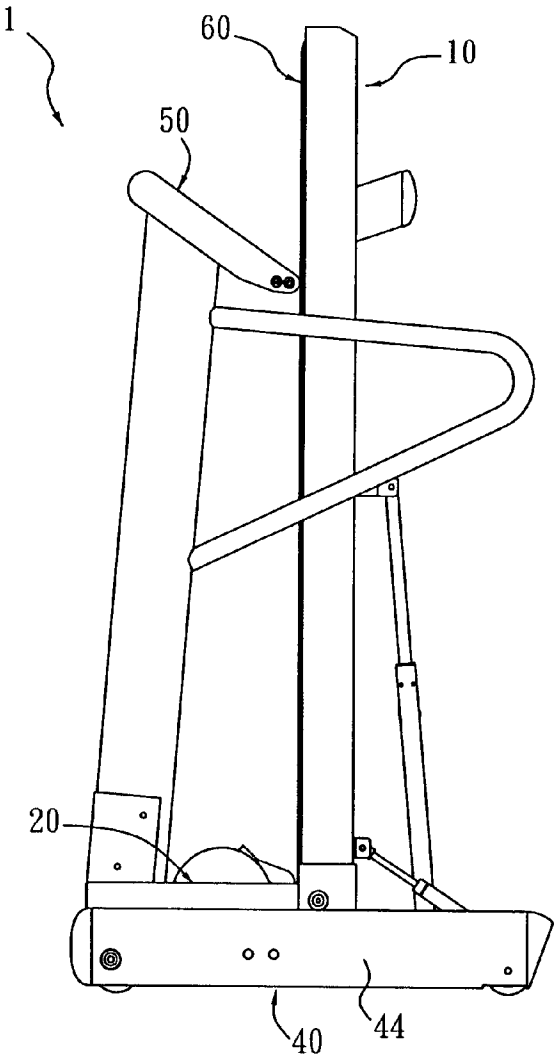
FIG. 7 is a side schematic view showing the status that the frame is completely collapsed.

When the user intends to collapse the treadmill 1, it is only required to release the front and rear frame assemblies 20, 30 to be a horizontal status (with reference to FIG. 3) and then to flip over the rear frame assembly 30 upward, along the pivoting position 33 on which the front and rear frame assemblies 20 and 30 pivots each otter (with reference to FIGS. 6 and 7). There is completely no need to take any procedure of releasing the engagement before collapsing and fastening the engagement after collapsing.

The aforementioned implementation is focused on a preferred structural concept, which modifies the conventional treadmill frame into a scissors type of supporting and lifting mechanism. Regardless of using or collapsing the treadmill, there is no need to take additional, complicated procedures. Also, such a conceptual design does not eliminate the functionality that the treadmill originally has but on the contrary, fulfills the ergonomic requirement. There may be any kind of variations and modifications made by person skilled in this field without departing from the technical theory of the invention. Persons skilled in this field may make a change of slidably pivoting relation between the front legs 421 and the rear legs 441, or the rear legs 441 and the front frames 21 in the other embodiment. By way of example only, they may make a change of the location of one end of the lifting device 46 to rear leg assembly 44, or make a change of rollers 422 to be disposed on the rear legs 441 and then reversibly define the receiving spaces in the front legs 421; or in the other embodiment (not shown), make a change of rollers to be disposed on the front frames 21 and then reversibly define the receiving spaces in the rear legs 441. Furthermore, they may additionally provide auxiliary supports 80, 81 between the rear frame assembly 30 and the rear leg assembly 44 in order to accomplish identical or similar effectiveness that the invention performs. However, such variations and modification shall still be covered in the scope defined by the following claims.

The invention claimed is:

1. An improved frame structure of a collapsible treadmill, comprising:

a front frame assembly, having a first end portion and a second end portion opposing to the first end portion;

a rear frame assembly, having a first end portion and a second end portion opposing to the first end portion, in which the first end portion pivots on the second end portion of the front frame assembly;

lifting mechanism, substantially disposed under the front frame assembly, in which the lifting mechanism includes a front leg assembly, a rear leg assembly and a lifting device, wherein the front leg assembly has a first end portion and a second end portion, and the rear leg assembly also has a first end portion and a second end portion, of which the first end portion of the front leg assembly pivots on the second end portion of the front frame assembly, and the first end portion of the rear leg assembly pivots on the first end portion of the front frame assembly;

wherein the front leg assembly and rear leg assembly slidably pivot with each other, and wherein the lifting device pivots on the front frame assembly at an end thereof and pivots on one of the front leg assembly and the rear leg assembly at the other end thereof.

2. The improved frame structure of a collapsible treadmill as claimed in claim 1, wherein the rear frame assembly comprises two rear frames opposing to each other and the front frame assembly comprises two front frames opposing to each other, of which the rear frames pivot on the front frames.

3. The improved frame structure of a collapsible treadmill as claimed in claim 2, wherein the front leg assembly of the lifting mechanism includes two front legs opposing to each other and the rear leg assembly of the lifting mechanism includes two rear legs opposing to each other, of which each of the front legs has a rear end pivoting on each of the front frames at a rear end of the front frame, and each of the rear legs has a front end pivoting on each of the front frames at a front end of the front frame, wherein the front legs slidably pivot on the rear legs.

4. The improved frame structure of a collapsible treadmill as claimed in claim 3, wherein each of the front legs is provided with a roller and each of the rear legs defines a sliding space in an interior thereof, so that the roller of each of the front legs is adapted to roll along the apace formed in the interior of each of the rear legs.

5. The improved frame structure of a collapsible treadmill as claimed in claim 4, wherein the lifting device pivots on the front frame assembly at an end thereof and pivots the front leg assembly at the other end thereof.

6. The improved frame structure of a collapsible treadmill as claimed in claim 5, wherein the front frame assembly further comprises a front transverse frame connected between the two opposing front frames, and wherein the front leg assembly further comprises a front transverse leg connected between the two opposing front legs, that the lifting device pivots on the front transverse frame at one end thereof and pivots on the front transverse leg at the other end thereof.

7. The improved frame structure of a collapsible treadmill as claimed in claim 6, wherein the lifting device comprises a power device and a lifting shaft, of which the power device is fixed to the front transverse frame, and wherein the lifting shaft is fixed to the power device at one end thereof and is pivoted on the front transverse leg at the other end thereof.

8. The improved frame structure of a collapsible treadmill as claimed in claim 1, wherein the lifting mechanism further comprises a front leg sliding device and a rear leg sliding device, of which the front leg sliding device is disposed on the second end portion of the front leg assembly, and the rear leg sliding device is disposed on the second end portion of the rear leg assembly.

9. An improved frame structure of a collapsible treadmill, comprising: a front frame assembly, having a first end portion and a second end portion opposing to the first end portion; a rear frame assembly, having a first end portion and a second end portion opposing to the first end portion, in which the first end portion pivots on the second end portion of the front frame assembly; lifting mechanism, substantially disposed under the front frame assembly, in which the lifting mechanism includes a front leg assembly, a rear leg assembly and a lifting device, wherein the front leg assembly has a first end portion and a second end portion, and the rear leg assembly also has a first end portion and a second end portion, of which the first end portion of the front leg assembly pivots on the second end portion of the front frame assembly, and the first end portion of the rear leg assembly slidably pivots on the first end portion of the front frame assembly; wherein the front leg assembly and rear leg assembly pivot with each other, and wherein the lifting device pivots on the front frame assembly at an end thereof and pivots on one of the front leg assembly and the rear leg assembly at the other end thereof.

10. The improved frame structure of a collapsible treadmill as claimed in claim 9, wherein the rear frame assembly comprises two rear frames opposing to each other and the front frame assembly comprises two front frames opposing to each other, of which the rear frames pivot on the front frames.

11. The improved frame structure of a collapsible treadmill as claimed in claim 9, wherein the lifting mechanism further comprises a front leg sliding device and a rear leg sliding device, of which the front leg sliding device is disposed on the second end portion of the front leg assembly, and the rear leg sliding device is disposed on the second end portion of the rear leg assembly.

* * * * *